US010125545B2

(12) United States Patent
Hsu et al.

(10) Patent No.: US 10,125,545 B2
(45) Date of Patent: Nov. 13, 2018

(54) PLACEMENT OF STABILIZERS, STANDOFFS, AND ROLLERS ON A DOWNHOLE TOOL STRING

(71) Applicant: Schlumberger Technology Corporation, Sugar Land, TX (US)

(72) Inventors: Kai Hsu, Sugar Land, TX (US); Fei Song, Stafford, TX (US); Weiming Lan, Sugar Land, TX (US); Derek Copold, Sugar Land, TX (US); Nathan Landsiedel, Clamart (FR); Arvind Battula, Sugar Land, TX (US); Daniel Schulz, Houston, TX (US); Sashank Vasireddy, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 230 days.

(21) Appl. No.: 14/975,694

(22) Filed: Dec. 18, 2015

(65) Prior Publication Data

US 2017/0175490 A1 Jun. 22, 2017

(51) Int. Cl.
*E21B 41/00* (2006.01)
*G05B 19/4099* (2006.01)
(Continued)

(52) U.S. Cl.
CPC ..... *E21B 4/18* (2013.01); *E21B 49/00* (2013.01); *E21B 49/08* (2013.01); *E21B 49/088* (2013.01)

(58) Field of Classification Search
CPC ..... E21B 17/028; B29C 64/00; B33Y 80/00; Y02P 10/295; G06F 17/50; B22F 3/1055
See application file for complete search history.

(56) References Cited

U.S. PATENT DOCUMENTS

2009/0316528 A1* 12/2009 Ramshaw ..... E21B 44/00 367/83
2011/0048700 A1* 3/2011 van Zuilekom ..... E21B 49/08 166/250.01

(Continued)

OTHER PUBLICATIONS

Annis et al., "Differential Pressure Sticking—Laboratory Studies of Friction Between Steel and Mud Filter Cake", Petroleum Transactions, SPE 151, May 1962, pp. 537-543.

(Continued)

*Primary Examiner* — Changhyun Yi
(74) *Attorney, Agent, or Firm* — Eileen Pape

(57) ABSTRACT

A manufacturing system that manufactures a downhole tool string, which includes a model that describes relationship between properties of the downhole tool string, properties of a borehole, properties of a formation, and properties of a mud cake formed on a surface of the borehole and a design device that iteratively determines contact parameters that describe one or more contact points expected between the downhole tool string and the mud cake based at least in part on the model, in which the contact parameters comprise contact force expected at each of the contact points, adjusts the properties of the downhole tool string to add a spacer at one of the contact points associated with highest contact force, and indicates location, type, or both of the spacer to enable the manufacturing system to attach the spacer to the downhole tool string before deployment of the downhole tool string in the borehole.

20 Claims, 9 Drawing Sheets

(51) Int. Cl.

| | |
|---|---|
| ***E21B 47/00*** | (2012.01) |
| ***E21B 4/18*** | (2006.01) |
| ***E21B 49/08*** | (2006.01) |
| ***E21B 49/00*** | (2006.01) |

(56) References Cited

U.S. PATENT DOCUMENTS

| | | | | |
|---|---|---|---|---|
| 2012/0166157 | A1* | 6/2012 | Whittaker | E21B 43/24 703/2 |
| 2014/0330520 | A1* | 11/2014 | Kwong | G01V 5/101 702/8 |
| 2014/0343857 | A1* | 11/2014 | Pfutzner | G01V 5/101 702/8 |
| 2017/0087622 | A1* | 3/2017 | Cook, III | B22C 9/22 |
| 2017/0211357 | A1* | 7/2017 | Grosz | E21B 41/0092 |
| 2017/0235007 | A1* | 8/2017 | Holtz | G01V 1/50 175/24 |
| 2017/0270225 | A1* | 9/2017 | Chen | G06F 17/50 |
| 2017/0321544 | A1* | 11/2017 | Wilson | E21B 49/00 |
| 2017/0336525 | A1* | 11/2017 | Wilson | G01V 3/28 |

OTHER PUBLICATIONS

Cerasi et al., "Measurement of the Mechnanical Properties of Filtercakes", SPE 68948, SPE European Formation Damage Conference, May 21-22, 2001, 12 pages.

Courteille et al., "A New Approach to Differential Sticking", SPE 14244, 60th Annual Technical Conference and Exhibition of the Society of Petroleum Engineers, Sep. 22-25, 1985, 10 pages.

Helmick et al., "Pressure-differential sticking of Drill Pipe and How It Can Be Avoided or Relieved", 57-055 API Conference Paper, 1957, pp. 55-61.

Outmans, "Mechanics of Differential Pressure Sticking of Drill Collars", 963-G SPE General, vol. 213, 1958, pp. 265-274.

Reid et al., "Differential-Sticking Mechanisms and a Simple Wellsite Test for Monitoring and Optimizing Drilling Mud Properties", SPE Drill & Completion, vol. 15, No. 2, Jun. 2000, pp. 97-104.

Underhill, "A Predictive Model for Wireline Tool Sticking", Sugar Land Product Center, Jun. 19, 1997, 40 pages.

Underhill et al., "Model-Based Sticking Risk Assessment for Wireline Formation Testing Tools in the U.S. Gulf Coast", SPE 48963, SPE Annual Technical Conference and Exhibition, Sep. 27-30, 1998, 11 pages.

* cited by examiner

PLACEMENT OF STABILIZERS, STANDOFFS, AND ROLLERS ON A DOWNHOLE TOOL STRING

BACKGROUND

The present disclosure relates generally to downhole tools and, more particularly, to placement of stabilizers, standoffs, and/or rollers on a downhole tool string.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Generally, a downhole tool may be deployed sub-surface, for example, to measure characteristics of a surrounding formation. To facilitate, the downhole tool may be moved within a borehole formed in the formation. For example, the downhole tool may be pushed to move the downhole tool farther into the borehole and/or pulled to remove the downhole tool from the borehole.

To form the borehole, a drill bit may excavate a portion of the formation. A drilling fluid, commonly referred to as "mud" or "drilling mud," may be pumped through the borehole, for example, to cool and/or lubricate the drill bit. Generally, the drilling mud may include solid particles, such as dirt, suspended in liquid, such as water. When the formation is porous, the liquid component of the drilling mud may be pushed into the formation leaving the solid component on the borehole wall. Overtime, a layer of the solid particles, commonly referred to as "mud cake," may form along the wall of the borehole.

When in contact, the mud cake may impede movement of the downhole tool within the borehole. For example, when stationary, the mud cake may harden around the downhole tool, thereby holding the downhole tool in place. Moreover, pressure differential (e.g., different between mud pressure and formation pressure) may push the downhole tool firmly against the borehole wall. In some cases, to detach the downhole tool from borehole wall, operations (e.g., fishing) may be performed. However, performing such operations may reduce the productivity time of the downhole tool. Even when in motion, the mud cake may contact the downhole tool, thereby causing friction that resists movement of the downhole tool. The resulting friction may cause movement of tool to be less predictable.

SUMMARY

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of embodiments of the present disclosure without limitation to the claimed subject matter.

A first embodiment describes a manufacturing system used to manufacture a downhole tool string to be deployed in a borehole formed in a sub-surface formation, including a model that describes relationship between properties of the downhole tool string, properties of the borehole, properties of the sub-surface formation, and properties of mud cake formed on a surface of the borehole; and a design device that iteratively determines contact parameters that describe one or more contact points expected between the downhole tool string and the mud cake based at least in part on the model, in which the contact parameters comprise contact force expected at each of the contact points, adjusts the properties of the downhole tool string to add a spacer at one of the contact points associated with highest contact force; and indicates location, type, or both of the spacer to enable the manufacturing system to attach the spacer to the downhole tool string before deployment of the downhole tool string in the borehole.

A second embodiment describes a method for manufacturing a downhole tool string to be deployed in a borehole formed in a sub-surface formation including determining, using a design device of a manufacturing system that assembles the downhole tool string, a first set of properties comprising downhole tool string properties, borehole properties, formation properties, and mud cake properties; determining, using the design device, first contact forces expected to occur between the downhole tool string and mud cake formed along a surface of the borehole based at least in part on the first set of the properties; determining, using the design device, a second set of the properties; determining, using the design device, second contact forces expected to occur between the downhole tool string and the mud cake; and indicating, using the design device, location, type, or both of one or more spacers to attach to the downhole tool string to enable the manufacturing system to attach the one or spacer to the downhole tool string before deployment of the downhole tool string in the borehole based at least in part on the first contact forces and the second contact forces.

A third embodiment describes a tangible, non-transitory, computer-readable medium that stores instructions executable by a processor in a manufacturing system used to manufacture a downhole tool string to be deployed in a borehole formed in a sub-surface formation. The instructions include instructions to determine, using the processor, first downhole tool string properties that indicate an initial placement of a plurality of standoffs along the downhole tool string; determine, using the processor, a first contact force expected to occur at each of the plurality of standoffs with mud cake expected to form along a surface of the borehole based at least in part on the first downhole tool string properties, borehole properties, mud cake properties, and formation properties; determine, using the processor, second downhole tool string properties that replace a first standoff of the plurality of standoffs with a first roller, in which the first contact force associated the first standoff is greater than the first contact force associated with rest of the plurality of standoffs; and instruct, using the processor, a design device in the manufacturing system to indicate location, type, or both of the first roller based at least in part on the second downhole tool string properties to facilitate the manufacturing system attaching the first roller to the downhole tool string before deployment in the borehole.

BRIEF DESCRIPTION OF THE DRAWINGS

Various aspects of this disclosure may be better understood upon reading the following detailed description and upon reference to the drawings in which.

DETAILED DESCRIPTION

Figure 1:
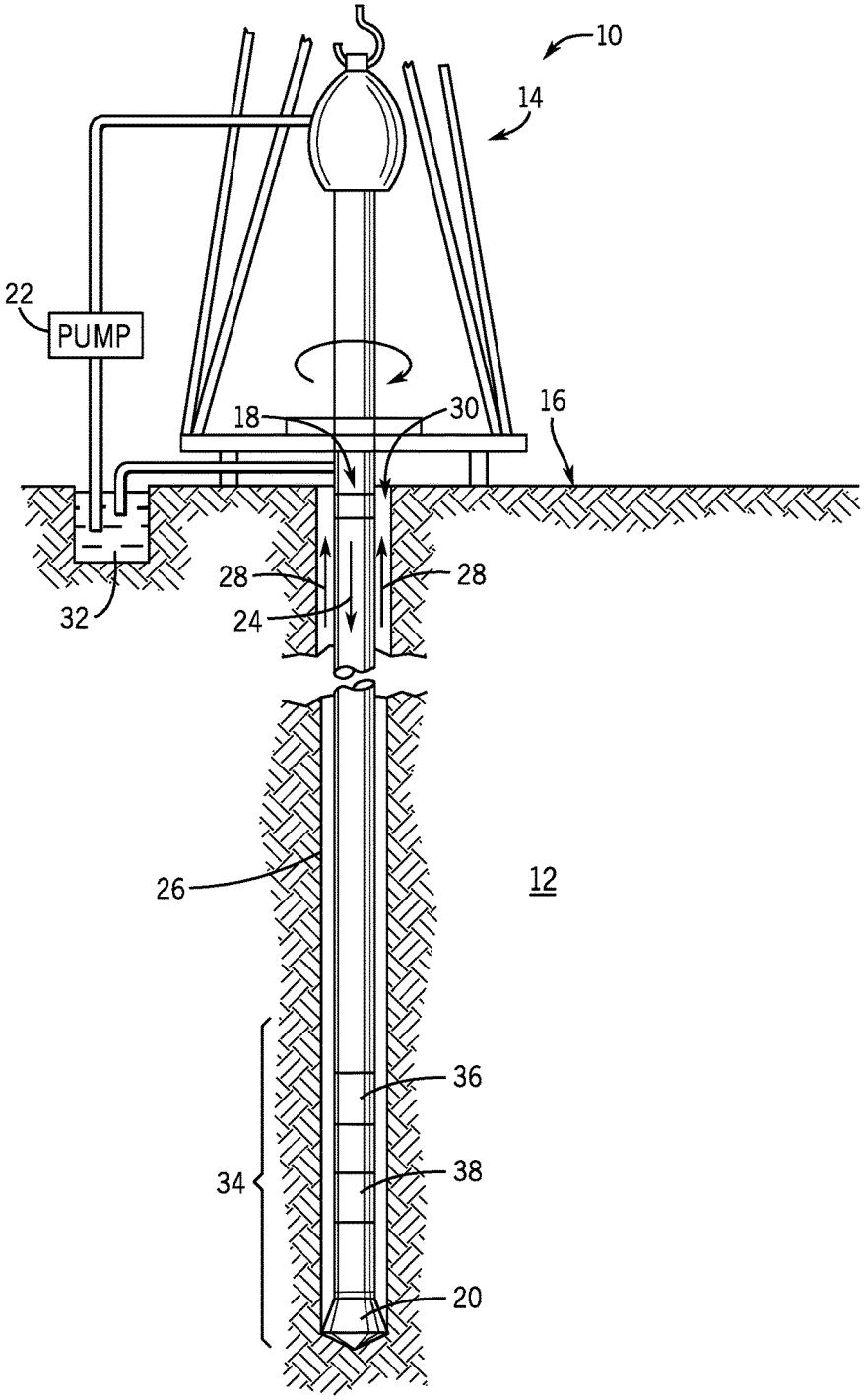
FIG. 1 is a schematic diagram of a drilling system including a downhole tool string, in accordance with an embodiment.

One or more specific embodiments of the present disclosure will be described below. These described embodiments are examples of the presently disclosed techniques. Additionally, in an effort to provide a concise description of these embodiments, not all features of an actual implementation may be described in the specification. It should be appreciated that in the development of any such actual implementation, as in any engineering or design project, numerous implementation-specific decisions will be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As mentioned above, a downhole tool may be deployed in a borehole to facilitate determining characteristics of a sub-surface formation. In some instances, multiple downhole tools may be connected together to form a downhole tool string. Additionally, as mentioned above, drilling mud may be pumped into the borehole. In some instances, the drilling mud in the borehole may exert a mud pressure on the formation greater than a formation pressure to facilitate reducing likelihood of fluid from the formation flowing out into the borehole and/or out to the surface. Due to the mud pressure, the liquid component of the drilling mud may flow into porous portions of the formation while the solid component of the drilling mud is blocked by the formation, thereby forming mud cake along the surface of the borehole.

Thus, in some instances, a portion of the downhole tool string may come in contact with the mud cake. For example, when the borehole is deviated (e.g., slanted), gravity and/or the mud pressure may cause the downhole tool string to contact the mud cake. Even when the borehole is vertical, the mud pressure and/or eccentered force exerted on the downhole tool string may cause the downhole tool string to contact the mud cake.

However, contacting the mud cake may impede movement of the downhole tool string within the borehole. For example, the downhole tool string may be stationary when one or more downhole tools are taking measurements. Since liquid content is low, mud cake may quickly harden. Thus, when in contact and stationary, the mud cake may quickly harden around contacting portions of the downhole tool string. After hardening and embedded in the mud cake, force used to resume movement of the downhole tool string may greatly increase.

In fact, in some instances, the force to resume movement may become so large that normal operating techniques may be insufficient to resume movement. In such instances, alternative techniques may be used to dislodge the contacting portions of the downhole tool string from the mud cake. For example, a fishing operation, in which a grasping mechanism is lowered into the borehole and attached to the downhole tool string, may be used. However, to utilize such alternative techniques, normal operation (e.g., drilling and/or logging) may be paused, thereby reducing productivity time.

When already in motion, the mud cake may not have sufficient time to harden around contacting portions of the downhole tool string. Nevertheless, the friction coefficient of the mud cake may be higher than the friction coefficient of the drilling mud. As such, when in contact, the mud cake may exert a greater amount of fiction on the downhole tool string compared to the drilling mud. Since in motion, amount of contact between the downhole tool string and the mud cake may be constantly changing, thereby causing amount of force to overcome friction to also constantly be changing. Thus, force used to move the downhole tool string may be less predictable and may, in fact, cause uneven (e.g., jerky or yo-yo effect) movement that jostles the downhole tools.

Accordingly, to reduce effect drilling mud has on movement of the downhole tool string, spacers may be attached to the downhole tool string to reduce contact area and, thus, contact force between the downhole tool string and the mud cake formed along the borehole wall. For example, when deployed while drilling the borehole, stabilizers (e.g., spacers) may be attached to the downhole tool string. Similarly, when deployed after drilling the borehole (e.g., via conveyance line), standoffs (e.g., spacers) may be attached to the downhole tool string. Generally, attaching a stabilizer and/or standoff may produce raised area along the downhole tool string, thereby increasing clearance between the housing of the downhole tool string and the borehole wall, thus, likelihood of the mud cake directly contacting the housing.

Additionally, rollers may be attached to downhole tool string, for example, when deploying via conveyance line. In some embodiments, a roller may include a mechanical component (e.g., a wheel or a ball) that rotates around a central axis when an external force is exerted. For example, when the mechanical component is in contact the mud cake, friction force between a surface of the mechanical component and the surface of the mud cake may cause the mechanical component to rotate as the downhole tool string is pulled along the borehole. Since the coefficient of friction resisting rotation of the mechanical component may be less than the sliding friction coefficient of the mud cake, force used to move the downhole tool string a travel distance may be reduced when a roller is attached compared to when a standoff is attached.

However, attaching spacers to a downhole tool string may increase the manufacturing cost of the downhole tool string. Additionally, manufacturing cost of a roller may be much larger than manufacturing cost of a standoff. Thus, in some instances, number of rollers available for attachment to a downhole tool string may be more limited compared to number of standoffs available. Moreover, attaching too many stabilizers and/or standoffs may begin to negate their advantage. For example, if standoffs are attached along the entire length of the downhole tool string, contact area between the downhole tool string and the mud cake may actually increase due to the larger radius of the standoffs.

Accordingly, the present disclosure provides techniques for determining placement of spacers (e.g., standoffs, stabilizers, and/or rollers) along a downhole tool string, for example, to reduce effect the mud cake may have on movement of the downhole tool string. In some embodiments, a design device may be used to determine design parameters, such as placement of spacers, of a downhole tool string. For example, to determine placement of spacers, the design device may use a model that describes expected interaction between the downhole tool string, the mud cake, the surrounding formation, and/or the borehole. In some embodiments, properties of the downhole tool string, properties of the mud cake, properties of the surrounding formation, and/or properties of the borehole may provide an indication of how each is expected to interact with its surroundings. As such, based on the properties, the design device may use the model to determine contact parameters, such as location of contact points between the downhole tool string and the mud cake, number of contact points, whether a contact point is between the housing or a spacer, and/or contact force at a contact point.

Based at least in part on the contact parameters, the design device may determine place of spacers along the downhole tool string. For example, the design device may determine a contact metric based on the contact parameters and compare the contact metric to a threshold to determine placement of standoffs and/or stabilizers along the downhole tool string. In some embodiments, the contact metric may be number of contact points between the downhole tool string housing and the mud cake, average contact force between the downhole tool string housing and the mud cake, and/or total contact force along the downhole tool string. When the contact metric is greater than the threshold, the design device may place a standoff and/or stabilizer at a contact point associated with the highest contact force.

Since adding a spacer (e.g., a standoff or stabilizer) increase clearance between the downhole tool string housing and the mud cake, the deformation (e.g., properties) of the downhole tool string may change, thereby also changing interaction with the mud cake. As such, the design device may iteratively use the model to determine the contact parameters after a spacer is added until the contact metric is no longer greater than the threshold and/or no more spacers are available. In this manner, the design device may determine number and/or location of standoffs and/or stabilizers to attach to the downhole tool string.

As described above, attaching rollers may reduce effect mud cake has on movement of the downhole tool string, but may be more limited in number compared to standoffs. Thus, in some embodiments, the design device may replace standoffs with rollers based at least in part on the contact parameters. For example, the design device may use the model to determine contact force at each standoff attached to the downhole tool string. When rollers are available, the design device may replace the standoff associated with the highest contact force with a roller. The design device may then iteratively use the model to determine the contact parameters after a roller is added until no more rollers are available and/or all standoffs have been replaced.

Furthermore, in some instances, properties of the mud cake, the formation, and/or the borehole surrounding the downhole tool string may change as the downhole tool string is moved along the borehole. Additionally, in some instances, the properties of the mud cake, the mud cake, the formation, and/or the borehole may include some uncertainty (e.g., ranges). To help account for variations in the properties, the design device may determine multiple sets of properties and determine contact parameters for each. In some embodiments, the design device may determine placement of spacers based on average contact forces along the downhole tool string. In other embodiments, the design device may determine placement of spacers based on peak contact forces along the downhole tool string.

To help illustrate, FIG. 1 describes a drilling system 10 that may be used to drill a well through sub-surface formations 12, thereby forming a borehole 26. In the depicted embodiment, a drilling rig 14 at the surface 16 may rotate a drill string 18, which includes a drill bit 20 at its lower end, to engage the sub-surface formations 12. To cool and/or lubricate the drill bit 20, a drilling fluid pump 22 may pump drilling mud 28 from a mud pit 32, through the center 24 of the drill string 18 to the drill bit 20. At the drill bit 20, the drilling mud 28 may then exit the drill string 18 through ports (not shown) and flow into the borehole 26. While drilling, the drilling mud 28 may be pushed toward the surface 16 through an annulus 30 between the drill string 18 and the formation 12, thereby carrying drill cuttings away from the bottom of the borehole 26. Once at the surface 16, the returned drilling mud 28 may be filtered and conveyed back to the mud pit 32 for reuse. Additionally, the drilling mud 28 may exert a mud pressure on the formation 12 to reduce likelihood of fluid from the formation 12 leaking into the borehole 26 and/or out to the surface 12.

Additionally, as depicted, the lower end of the drill string 18 includes a downhole tool string 34 that includes various downhole tools, such a measuring-while-drilling (MWD) tool 36 and a logging-while-drilling (LWD) tool 38. Generally, the downhole tools (e.g., MWD tool 36 and LWD tool 38) may facilitate determining characteristics of the surrounding formation 12. For example, the LWD tool 38 may include an electrically operated radiation generator, which outputs radiation into the surrounding formation 12, and one or more sensors, which may measure radiation returned from the surrounding formation 12, surrounding pressure, and/or surrounding temperature.

Figure 2:
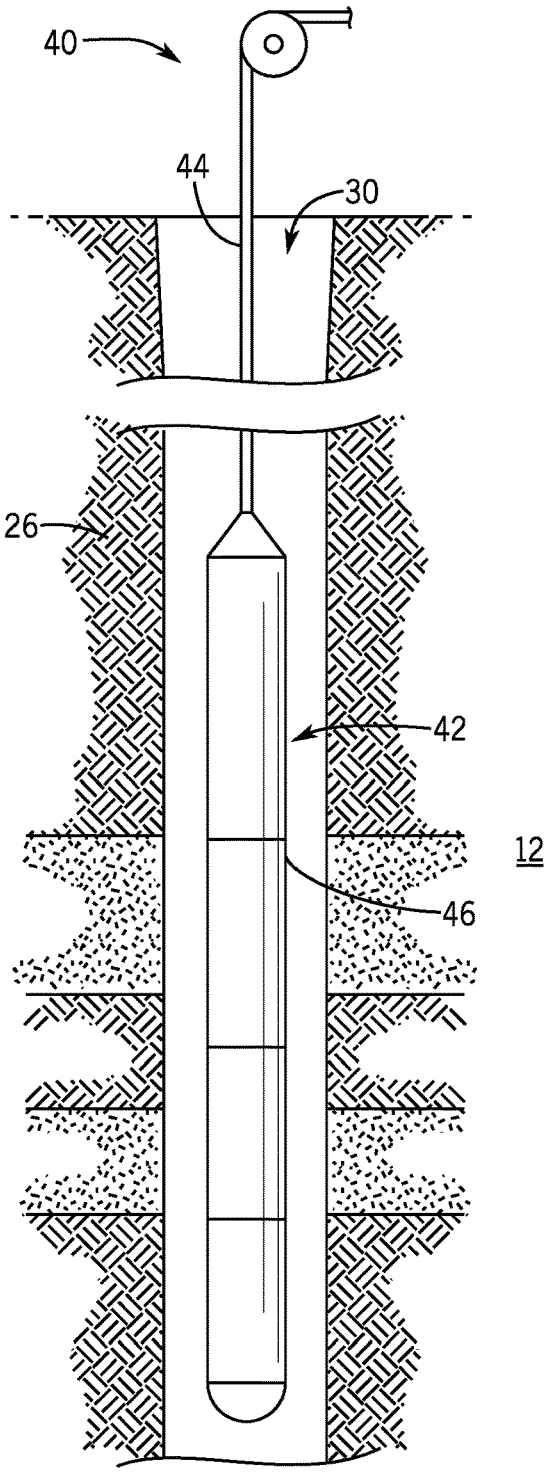
FIG. 2 is a schematic diagram of a conveyance line system including a downhole tool string, in accordance with an embodiment.

After drilling, downhole tools may be also be deployed in the borehole 26, for example, via a conveyance line. To help illustrate, a conveyance line system 40, which may be used to deploy downhole tools in the borehole 26, is described in FIG. 2. In the depicted embodiment, the conveyance line system 52 includes a downhole tool string 34 with various downhole tools, such as a formation testing tool 46. Generally, the downhole tools (e.g., formation testing tool 46) may facilitate determining characteristics of the surrounding formation 12. For example, the formation testing tool 46 may include an electrically operated radiation generator, which outputs radiation into the surrounding formation 12, and one or more sensors, which may measure radiation returned from the surrounding formation 12, surrounding pressure, and/or surrounding temperature.

Additionally, the conveyance line system 40 includes a cable 44 to facilitate controlling movement of the downhole tool string 34. In some embodiments, the conveyance line system 40 may be a wireline system when the cable 44 is an armed electrical cable that enables bi-directional communication between the downhole tool string 34 and the surface. In other embodiments, the conveyance line system 40 may be a slickline system when the cable 44 is used to support the downhole tool string 46, but does not provide direct communication between the downhole tool string 46 and the surface. Thus, in a wireline system or a slickline system, movement of the downhole tool string 34 may be controlled by exerting force on the cable 44 to pull the downhole tool string 34 up the borehole 24 and/or by reducing force exerted on the cable 44 to enable gravity to pull the downhole tool string 34 down the borehole 24.

In other embodiments, the conveyance line system 40 may be a coil tubing system when the cable 44 is a coiled tube. In such embodiments, movement of the downhole tool string 34 may be controlled again by exerting force on the cable 44 to pull the downhole tool string 34 up the borehole 24. However, to supplement force exerted by gravity, force may be exerted on the coiled cable 44 to push the downhole tool string 34 down the borehole 24. Thus, using a coiled cable 44 may facilitate controlling movement of the downhole tool string 34 particularly when the borehole 24 is deviated (e.g., slanted away from vertical).

Even after drilling, the drilling mud 28 may remain in the borehole 26 to exert a mud pressure on the formation 12. In some embodiments, the mud pressure may be greater than the formation pressure to reduce likelihood of fluid from the formation 12 leaking into the borehole 26 and/or out to the surface. Thus, when porous, the mud pressure may cause the formation 12 to filter the drilling mud 28. More specifically, since greater than the formation pressure, the mud pressure may cause a liquid component (e.g., water) of the drilling mud 28 to follow into pores of the formation 12. When the pores are smaller than size of a particle component (e.g., dirt) of the drilling mud 28, the formation 12 may block the particle component. In such instances, a mud cake (e.g., particle component with decreased liquid component) may form along the surface of the borehole 26 and, thus, may contact the downhole tool string 34.

Figure 3:
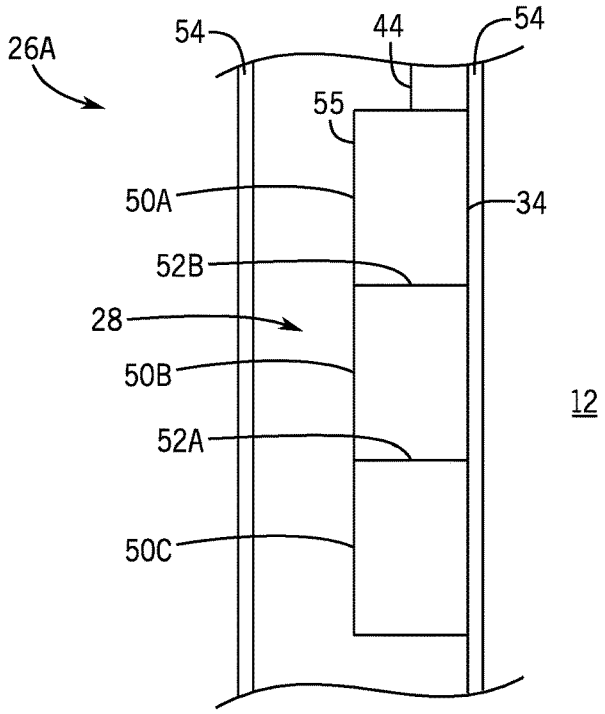
FIG. 3 is a schematic diagram of the downhole tool string of FIG. 2 in contact with mud cake in a vertical borehole, in accordance with an embodiment.
Figure 4:
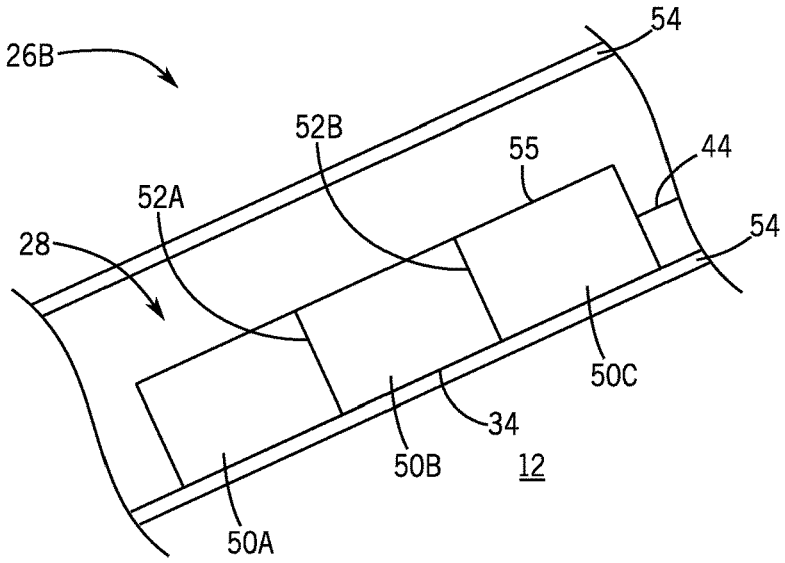
FIG. 4 is a schematic diagram of the downhole tool string of FIG. 2 in contact with mud cake in a deviated borehole, in accordance with an embodiment.

To help illustrate, a downhole tool string 34 deployed in two examples of boreholes 26 is described in FIGS. 3 and 4. More specifically, FIG. 3 describes a substantially vertical borehole 26A and FIG. 4 describes a deviated (e.g., slanted) borehole 26B. As depicted in FIGS. 3 and 4, a cable 44 is coupled to the downhole tool string 34 and, thus, used in a conveyance line system 40. It should be noted that reference is made to a conveyance line system 40 to simplify discussion and not intended to be limiting. One of ordinary skill in the art should recognize that the techniques described herein are also applicable for use in the drilling system 10.

As described above, the downhole tool string 34 may include multiple downhole tools 50. In some embodiments, the downhole tools 50 may be connected using field joints 52. For example, as depicted in FIGS. 3 and 4, the downhole tool string 34 includes a first field joint 52A connected between a first downhole tool 50A and a second downhole tool 52B and a second filed joint 52B connected between the second downhole tool 52B and a third downhole tool 52C.

Additionally, as described above, drilling mud 28 may be disposed in the borehole 26 to exert a mud pressure on the formation 12 greater than the formation pressure. Furthermore, as described above, the mud pressure may cause the formation 12 to filter the liquid component of the drilling mud 28 from the solid component. As depicted in FIGS. 3 and 4, the solid component of the drilling mud 28 is blocked by the formation 12, thereby forming a mud cake 54 along the surface of the borehole 26.

Furthermore, as described above, the downhole tool string 34 may come in contact with the mud cake 54. For example, as depicted in FIG. 3, the downhole tool string 34 comes in contact with mud cake 54 formed along a right surface of the vertical borehole 26A. Although substantially vertical, the downhole tool string 34 may come in contact with the mud cake 54 when an uncentered force is exerted on the downhole tool string 34, for example, due to force exerted by the cable 44 and/or the mud pressure.

Additionally, as depicted in FIG. 4, the downhole tool string 34 comes in contact with mud cake 54 formed along a bottom surface of the deviated borehole 26. The downhole tool string 34 may come in contact with the mud cake 54 due to force exerted by gravity. In addition to gravity, the mud pressure may also push the downhole tool string 34 toward the mud cake 54.

As depicted in FIGS. 3 and 4, housing 55 of the downhole tool string 34 is substantially uniform. Since relatively rigid, when the housing 55 contacts the mud cake 54 it may be for an extended length. Since friction force is largely based on contacting surface area, force used to move the downhole tool string 34 along the borehole 26 may greatly increase when the housing 55 is directly in contact with the mud cake 54.

To facilitate reducing force used to move the downhole tool string 34, spacers may be attached to the downhole tool string 34 to increase clearance between the housing 55 and the mud cake. Examples of spacers that may be attached to the downhole tool string 34 are described in FIGS. 5 and 6. More specifically, FIG. 5 describes the downhole tool string 34 with standoffs 58 attached and FIG. 6 describes the downhole tool string with a combination of standoffs 58 and rollers 60 attached.

Figure 5:
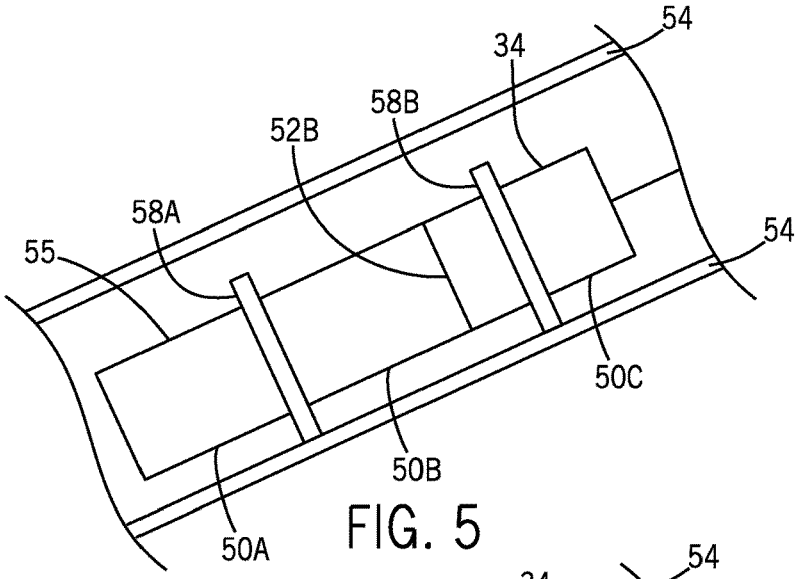
FIG. 5 is a schematic diagram of standoffs attached to the downhole tool string of FIG. 2, in accordance with an embodiment.

As depicted in FIG. 5, a first standoff 58A and a second standoff 58B are attached to the downhole tool string 34. In some embodiments, the standoffs 58 may be attached around the housing 55 of the downhole tool string 34, thereby producing a raise area along the downhole tool string 34. As such, a standoff 58 may come in contact with the mud cake 54 before the housing 55. In this manner, a standoff 58 may increase clearance between the mud cake 54 and the housing 55, thereby reducing likelihood of the housing 55 directly contacting the mud cake 54.

Additionally, in some embodiments, the standoffs 58 may be connected at field joint 52 locations. For example, in the depicted embodiment, the first standoff 58A is connected at the first field join 52A. However, in other embodiments, the standoffs 58 may be connected at any suitable location along the downhole tool string 34. For example, in the depicted embodiment, the second standoff 58B is connected at the third downhole tool 50C and not at a field joint 52.

In a drilling system 10, stabilizers may be used instead of standoffs 58. In some embodiments, a stabilizer may be a balloon attached around the housing 55 of the downhole tool string 34. As such, a stabilizer may function similarly to a standoff 58 by increasing clearance between the mud cake 54 and the housing 55. Thus, one of ordinary skill in the art should recognize the techniques describe with reference to standoffs 58 used in a conveyance line system 40 may be interchanged with stabilizers when used in a drilling system 10.

Figure 6:
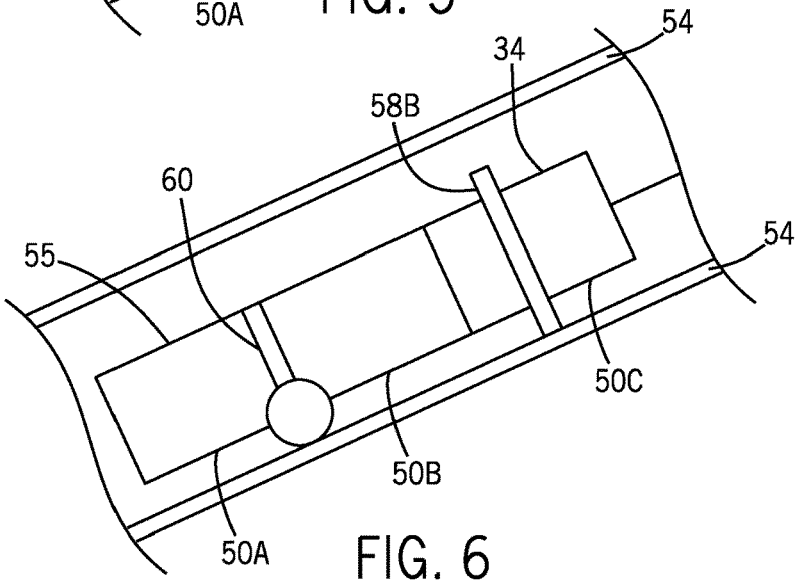
FIG. 6 is a schematic diagram of a roller and a standoff attached to the downhole tool string of FIG. 2, in accordance with an embodiment.

As depicted in FIG. 6, the first standoff 58A is replaced with a roller 60. In addition to increasing clearance between the mud cake 54 and the housing 55, the roller 60 may include a mechanical component (e.g., a wheel or a ball) that rotates about a central axis when in motion and in contact with the mud cake 54. As such, compared to a standoff 58, attaching a roller 50 to the downhole tool string 34 may further reduce force used to move the downhole tool string 34 along the borehole 26. Thus, in some embodiments, a standoff 58 may be replaced with a roller 60. In other embodiments, a roller 60 may be attached to supplement existing standoffs 58.

Similar to standoffs 58, in some embodiments, roller 60 may be connected at field joint locations 52. For example, in the depicted embodiment, the roller 60 is connected at the first field join 52A. However, in other embodiments, the roller 50 may be connected at any suitable location along the downhole tool string 34. For example, in such embodiments, the second standoff 58B may additionally or alternatively be replaced with a roller 60.

In some embodiments, a manufacturing system (e.g., plant) may include machines and/or equipment that assemble the downhole tool string 34 before deployment in the borehole 26. For example, the manufacturing system may attach spacers to the downhole tool string 34. However, determining location and/or type of spacers to attach to the downhole tool string 34 may include consideration of various factors. For example, since spacers are generally additional components attached to the downhole tool string 34, increasing number of spacers may increase manufacturing cost of the downhole tool string 34. Additionally, number of different types (e.g., standoffs 58 and rollers 60) of spacers available for use with the downhole tool string 34 may vary. Moreover, attaching too many stabilizers and/or standoffs may begin to negate their advantage. Thus, the manufacturing system may include a design device that determine location and type of the spacers to attach to the downhole tool string 34 based at least in part on the various factors.

Figure 7:
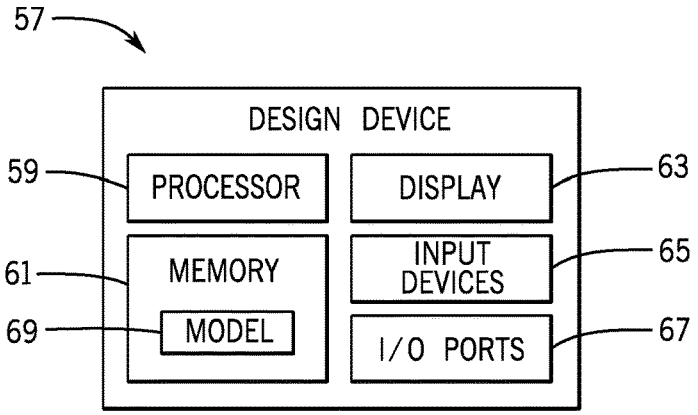
FIG. 7 is a block diagram of a design device, in accordance with an embodiment.

To help illustrate, one embodiment of a design device 57 that may be used in a manufacturing system is described in FIG. 7. As depicted, the design device 57 includes a processor 59, memory 61, a display 63, input device 65, and input/output (I/O) ports 67. Thus, the design device 10 may be any suitable electronic device, such as a handheld computing device, a tablet computing device, a notebook computer, a desktop computer, a workstation computer, a cloud-based computing device, or any combination of such devices.

In the depicted embodiment, the processor 59 may execute instruction stored in memory 59 to perform operations, such determining location and/or type of spacers to attach to the downhole tool string 34. As such, the processor 59 may include one or more general purpose microprocessors, one or more application specific processors (ASICs), one or more field programmable logic arrays (FPGAs), or any combination thereof. Additionally, the memory 61 may be a tangible, non-transitory, computer-readable medium that store instructions executable by and data to be processed by the processor 59. For example, in the depicted embodiment, the memory 61 may store a model 69 that describes interaction between the downhole tool string 34, the formation 12, the borehole 26, and/or the mud cake 54. Thus, the memory 61 may include random access memory (RAM), read only memory (ROM), rewritable non-volatile memory, flash memory, hard drives, optical discs, and the like.

Furthermore, I/O ports 67 may enable the design device 67 to interface with various other electronic devices. For example, the I/O ports 67 may enable the design device 67 to communicatively couple to a network, such as a personal area network (PAN), a local area network (LAN), and/or a wide area network (WAN). Accordingly, in some embodiments, the design device 57 may receive the model 69 from another electronic device and/or communicate determined location and/or type of spacers to another electronic device via the I/O ports 67, for example, to enable the manufacturing system to implement when assembling the downhole tool string 34.

Additionally, the input devices 65 may enable a user to interact with the design device 57, for example, to input properties and/or input instructions (e.g., control commands). Thus, in some embodiments, the input device 65 may include buttons, keyboards, mice, trackpads, and the like. Additionally or alternatively, the display 63 may include touch components that enable user inputs to the design device 57 by detecting occurrence and/or position of an object touching its screen (e.g., surface of the display 63). In addition to enabling user inputs, the display 64 may present visual representations of information, such as indication of the location and/or type of spacers to attach to a downhole tool string 34 to facilitate implementation (e.g., assembly) by the manufacturing system.

As described above, the design device 57 may use the model 69 to facilitate determine location and/or type of spacers to attach to the downhole tool string 34. In some embodiments, the model 69 may be finite element analysis (FEA) model. Additionally, in some embodiments, the model 69 may describes expected interaction between the downhole tool string 34, the mud cake 54, the formation 12, and/or the borehole 26. In some embodiments, properties of the downhole tool string 34, properties of the mud cake 54, properties of the formation 12, and/or properties of the borehole 26 may provide an indication of how each is expected to interact with its surroundings and, thus, be inputs to the model 69.

For example, the properties of the downhole tool string 34 may include length of the downhole tool string 34, weight of the downhole tool string 34, size of the housing 55, weight distribution along the downhole tool string 34, material composition of the housing 55, rigidity of the material composition, type of downhole tools 55 included in the downhole tool string 34, location of spacers attached to the downhole tool string, size (circumference and/or geometry) of each spacer attached to the downhole tool string 34, type (e.g., stabilizer, standoff 58, or roller 60) of each spacer attached to the downhole tool string 34, and/or the like. Additionally, the properties of the mud cake 54 may include material composition of the mud cake 54, thickness of the mud cake 54, and the like. Furthermore, the properties of the formation 12 may include permeability of the formation 12, porosity of the formation 12, and/or the like. The properties of the borehole 26 may include the deviation (e.g., degrees from vertical) of the borehole 26, size (e.g., circumference) of borehole 26, and/or the like.

Using the model 69, the design device 57 may determine contact parameters that describe expected contact points between the downhole tool string 34 and the mud cake 54. In some embodiments, the contact parameters may include location of contact points, number of contact points, what part (e.g., standoff 58, roller 60, and/or housing 55) of the downhole tool string 34 is at the contact point, contact force at each contact point, and/or the like. Based at least in part on the contact parameters, the design device 57 may then determine location and/or type of spacers to attach to the downhole tool string 34.

Figure 8:
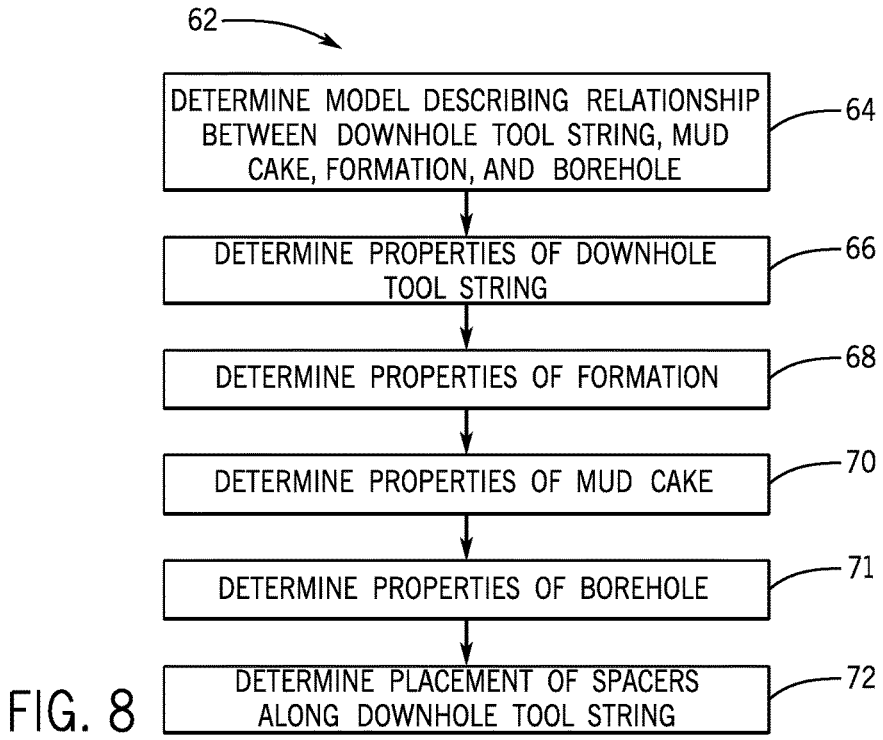
FIG. 8 is a flow diagram of a process for determining placement of spacers along a downhole tool string, in accordance with an embodiment.

To help illustrate, one embodiment of a process 62 for determining placement of spacers along a downhole tool string 34 is described in FIG. 8. Generally, the process includes determining a model that describes relationship between a downhole tool string, mud cake, a formation, and borehole properties (process block 64), determining properties of the downhole tool string (process block 66), determining properties of the formation (process block 68), determining properties of the mud cake (process block 70), determining properties of the borehole (process block 71), and determining placement of spacers along the downhole tool string (process block 72). In some embodiments, the process 62 may be implemented by executing instructions stored in a tangible, non-transitory, computer-readable medium, such as the memory 61 or the like, using processing circuitry, such as the processor 59 or the like.

Accordingly, in some embodiments, the design device 57 may determine the model 69 (process block 64). When stored in memory 61, the design device 57 may retrieve the model 69 from memory 61. Additionally or alternatively the design device 57 may receive the model 69 from another electronic device, for example, via the I/O ports 67.

Additionally, the design device 57 may determine properties of the downhole tool string 34 (process block 66). As described above, the properties of the downhole tool string 34 may include length of the downhole tool string 34, weight of the downhole tool string 34, size of the housing 55, weight distribution along the downhole tool string 34, material composition of the housing 55, rigidity of the housing 55, type of downhole tools 55 included in the downhole tool string 34, location of spacers attached to the downhole tool string, size (circumference and/or geometry) of each spacer attached to the downhole tool string 34, type (e.g., stabilizer, standoff 58, or roller 60) of each spacer attached to the downhole tool string 34, and/or the like. In some embodiments, the properties of the downhole tool string 34 may be directly measured while on the surface 16, for example, in the manufacturing system. Thus, the properties of the downhole tool string 34 may be determined with relative certainty. In some embodiments, the properties of the downhole tool string 34 may be manually entered into the design device 57 via the user inputs 65. Additionally or alternatively, the design device 57 may receive the properties of the downhole 34 from another electronic device (e.g., a sensor), for example, via the I/O ports 67.

The design device 57 may also determine properties of the formation 12 (process block 68). As described, the properties of the formation 12 may include permeability of the formation 12, porosity of the formation 12, and/or the like. When deep under the surface 16, properties of the formation 12 may be difficult to directly determine, particularly since the downhole tools 50 used to determine the properties of the formation 12 are part of the downhole tool string 34 and, thus, not yet deployed. As such, the properties of the formation 12 may include some uncertainty. In some embodiments, the properties of the formation 12 may be manually entered into the design device 57 via the user inputs 65. Additionally or alternatively, the design device 57 may receive the properties of the formation 12 from another electronic device (e.g., a sensor), for example, via the I/O ports 67.

Additionally, the design device 57 may determine properties of the mud cake 54 (process block 70). As described above, the properties of the mud cake 54 may include material composition of the mud cake 54, thickness of the mud cake 54, and/or the like. Thus, in some embodiments, the properties mud cake 54 may be dependent on at least properties of drilling mud 58 in the borehole 26, mud pressure, pumping pressure with which the drilling mud 58 is pumped into the borehole, and/or properties of the formation 12 (e.g., porosity). Properties of the drilling mud 28 may be determined on the surface 16 with relative certainty, but may change as the drilling mud 28 follows in the borehole 26. Additionally, since based on properties of the formation 12, the properties of the mud cake 54 may also include some uncertainty. In some embodiments, the properties of the mud cake 54 may be manually entered into the design device 57 via the user inputs 65. Additionally or alternatively, the design device 57 may receive the properties of the mud cake 54 from another electronic device (e.g., a sensor), for example, via the I/O ports 67.

Furthermore, the design device 57 may determine properties of the borehole 26 (process block 71). As described above, the properties of the borehole 26 may include angle (e.g., degrees from vertical) of the borehole 26, size of borehole 26, and/or the like. In some instances, properties of shallow portions of the borehole 26 may be determined with relative certainty. However, properties of the borehole 26 may change over its length. As such, properties of deeper portions of the borehole 26 may be determined with less certainty. In other words, certainty of the properties of the borehole 26 may vary based on depth. In some embodiments, the properties of the borehole 26 may be manually entered into the design device 57 via the user inputs 65. Additionally or alternatively, the design device 57 may receive the properties of the borehole 26 from another electronic device (e.g., a sensor), for example, via the I/O ports 67.

Using the model 69, the design device 57 may then determine the location and/or type of spacers to attach along the downhole tool string 72 based at least in part on the properties of the downhole tool string 34, the formation 12, the mud cake 54, and the borehole 26 (process block 72). For example, in some embodiments, the design device 57 may determine where to place standoffs 58 along the downhole tool string 34. In other embodiments, the design device 57 may determine what standoffs 58 to replace with roller 60. In further embodiments, the design device 57 may determine where to place a combination of roller 60 and standoffs 58.

Figure 9:
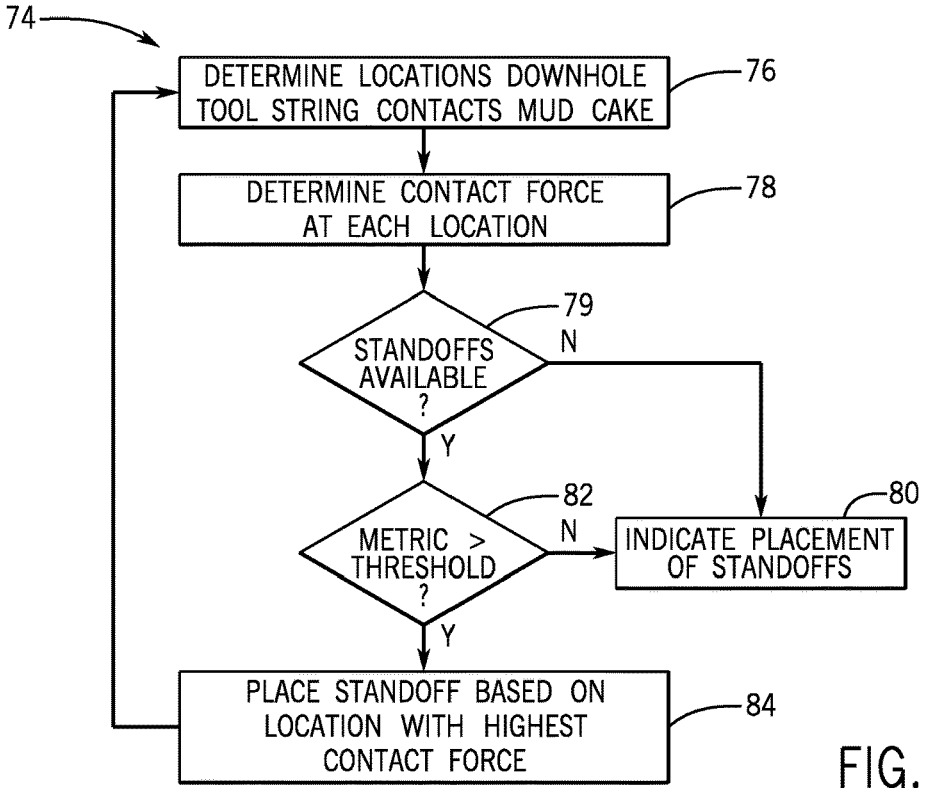
FIG. 9 is a flow diagram of a process for determining placement of standoffs along a downhole tool string, in accordance with an embodiment.

To help illustrate, one embodiment of a process 74 for determining placement of standoffs 58 along a downhole tool string 34 is described in FIG. 9. Generally, the process 74 includes determining locations where a downhole tool string contacts mud cake (process block 76), determining contact force at each location (process block 78), determining whether standoffs are available (decision block 79), and indicating placement of standoffs when no more standoffs are available (process block 80). When standoffs are available, the process 74 includes determining whether a contact metric is greater than a threshold (decision block 82), placing a standoff at a location with highest contact force when the contract metric is greater than the threshold (process block 84), and indicating placement of standoffs when the contact metric is not greater than the threshold (process block 80). In some embodiments, the process 74 may be implemented by executing instructions stored in a tangible, non-transitory, computer-readable medium, such as the memory 61 or the like, using processing circuitry, such as the processor 59 or the like.

Accordingly, in some embodiments, the design device 57 may use the model 69 to determine locations (e.g., contact points) where the downhole tool string 34 is expected to contact the mud cake 54 (process block 76) and the contact force at each location (process block 78). In some embodiments, the design device 57 may determine what portion of the downhole tool string 34 is expected to contact the mud cake 54 based at least in part on profile of the contact force. Additionally, in some embodiments, the design device 47 may determine number contact points between the downhole tool string 34 and the mud cake based at least in part on number of peaks in the profile of the contact force.

Figure 10:
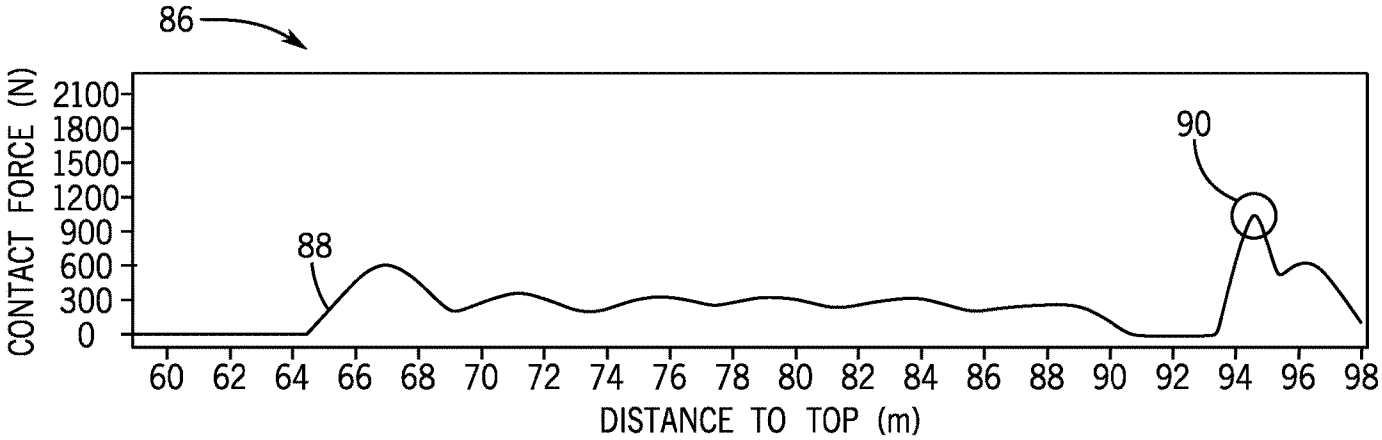
FIG. 10 is a plot of contact force along a downhole tool string with no spacers attached, in accordance with an embodiment.
Figure 11:
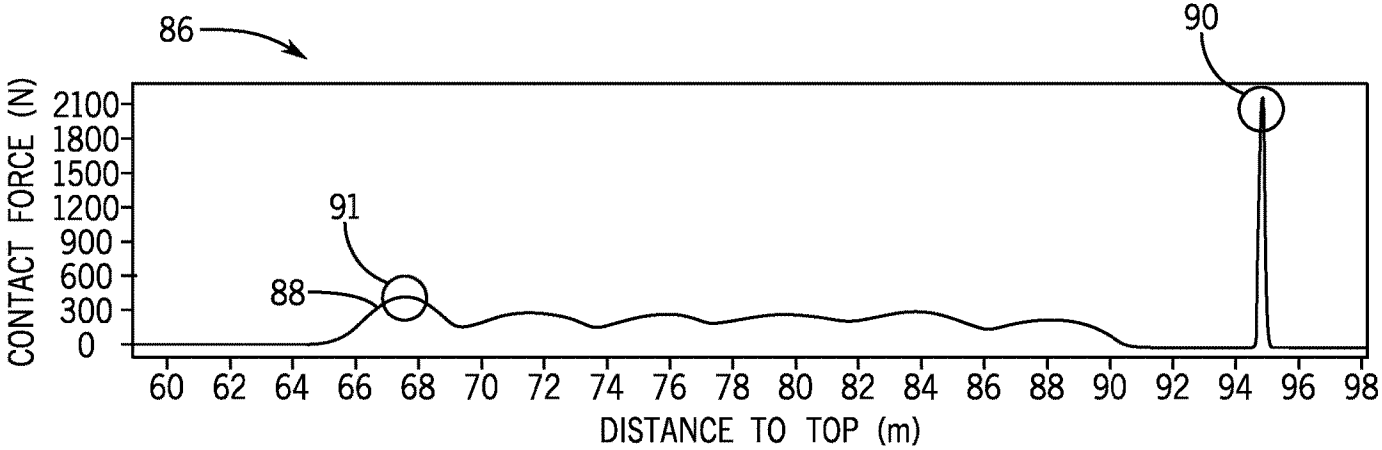
FIG. 11 is a plot of contact force along the downhole tool string with one standoff attached, in accordance with an embodiment.

To help illustrate, a plot 86 of a contact force curve 88 relative to length of the downhole tool string 34 is described in FIG. 10. In some embodiments, the model 69 may output the information represented by the contact force curve 88 for analysis by the design device 57. Based on the contact force curve 88, the design device 57 may determine that eight contact points are expected between the downhole tool string 34 and the mud cake 54 due to the eight peaks. Additionally, the design device 57 may determine that each of the contact points is with the housing 55 of the downhole tool string 34 since profile of the contact force curve 88 extends over extended lengths of the downhole tool string 34.

Returning to the process 74 of FIG. 9, the design device 57 may then determine whether any standoffs 58 are available for attachment to the downhole tool string 34 (decision block 79). In some embodiments, a finite number of standoffs 58 may set by the design device 57, for example, based on input via the user inputs 65. In other embodiments, the design device 57 may assume an infinite number of standoffs 58, for example, due to lower manufacturing cost.

When standoffs 58 are available, the design device 57 may determine whether a contact metric is greater than a threshold (decision block 82). In some embodiments, the contact metric may be number of contact points between the housing 55 and the mud cake 54. For example, assuming sufficient (e.g., infinite) number of standoffs 58, the design device 57 may iteratively perform the process 74 until number of contact points between the housing 55 and the mud cake 54 is less than or equal to a threshold number (e.g., zero). In other embodiments, the contact metric may be total contact force between the downhole tool string 34 and the mud cake 54. For example, assuming sufficient (e.g., infinite) number of standoffs 58, the design device 57 may iteratively perform the process 74 until total contact force between the downhole tool string 34 and the mud cake 54 is below a threshold force.

When the contact metric is greater than the threshold, the design device 57 may place a standoff 58 corresponding with a location (e.g., contact point) expected to have largest contact force between the housing 55 and the mud cake 54. For example, with regard to FIG. 10, the design device 57 may determine that a standoff 58 should be place at a contact point corresponding with a first circled point 90 since profile of the contact force curve 88 indicates that the contact point has the largest contact force with the housing 55.

Returning to the process 74 described in FIG. 9, the design device 57 may again determine locations the downhole tool string 34 contact the mud cake 54 (process block 76) and so. In other words, the design device 57 may iteratively perform the process 74 since properties of the downhole tool string 64 may change each time a standoff 58 is added.

To help illustrate, the plot 86 of the contact force curve 88 after the standoff 58 is added to the downhole tool string 34 is described in FIG. 10. Based on the contact force curve 88, the design device 57 may determine that the number of contact points is reduced from eight to seven after the standoff 58 is added. Additionally, based on the sharp peak, the design device 57 may determine that the contact point corresponding with the first circled point 90 is at a standoff, but the other six contact points are still are still with the housing 55. Assuming that available standoffs 58 remain and the contact metric is still greater than the threshold, the design device 57 may determine that a standoff 58 should be place at a contact point corresponding with a second circled point 91 since profile of the contact force curve 88 indicates that the contact point has the largest contact force with the housing 55.

Returning to the process 74 described in FIG. 9, the design device 57 may continue iteratively performing the process 74 until no more standoffs 58 remain and/or the contact metric is no longer greater than the threshold. Once either occurs, the design device 57 may indicate placement of standoffs 58 along the downhole tool string 34 (process block 80). In some embodiments, the design device 57 may indicate placement (e.g., location) of the standoffs 58 using the display 63 and/or communicate the placement of the standoffs 58 to another electronic device via the I/O ports 67. Based at least in part on the indication, the manufacturing system may instruct the machines and/or equipment to attach standoffs 58 to the downhole tool string 34. In some embodiments, the design device 57 may iteratively perform the process 74 to determine minimum number of standoffs 58 that enable the housing 55 not to directly contact the mud cake 54.

As described above, the design device 57 may determine what standoffs 58 to replace with rollers 60. In some embodiments, the placement of standoffs 58 may already be determined, for example, using the process 74 described in FIG. 9. Additionally or alternatively, a standoff 58 may be placed at default (e.g., initial) locations, for example, at each field joint 52 along the downhole tool string 34. Since roller 60 may further reduce force used to move the downhole tool string 34, the design device 57 may determine to replace one or more of the standoffs 58 with rollers 60.

Figure 12:
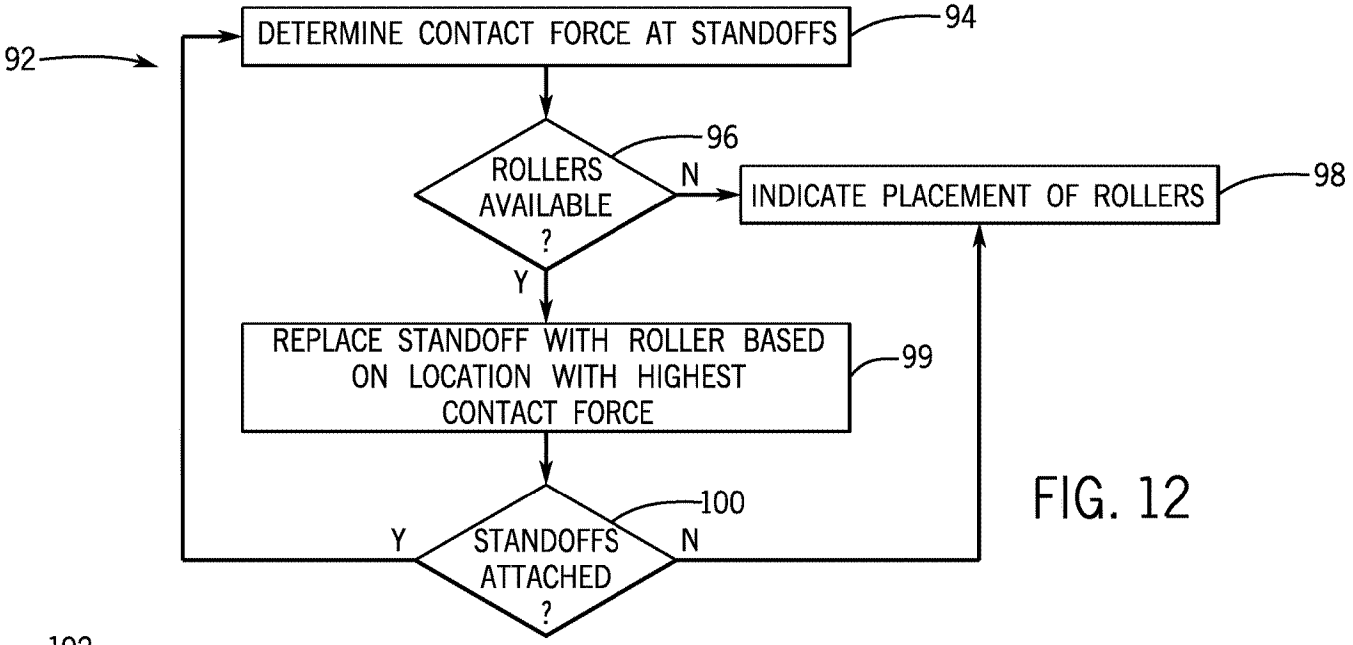
FIG. 12 is a flow diagram of a process for determining placement of rollers along a downhole tool string, in accordance with an embodiment.

To help illustrate, a process 92 describing for determining placement of roller 60 along a downhole tool string 34 is described in FIG. 12. Generally, the process 92 includes determining contact force at each standoff (process block 94), determining whether rollers are available (decision block 96), and indicating placement of rollers when no more rollers are available (process block 98). When roller are available, the process 92 includes replacing a standoff associated with highest contact force with a roller (process block 99), determining whether any standoffs remain attached to the downhole tool string (decision block 100), and indicating placement of rollers when no more standoffs remain attached (process block 98). In some embodiments, the process 92 may be implemented by executing instructions stored in a tangible, non-transitory, computer-readable medium, such as the memory 61 or the like, using processing circuitry, such as the processor 59 or the like.

Figure 13:
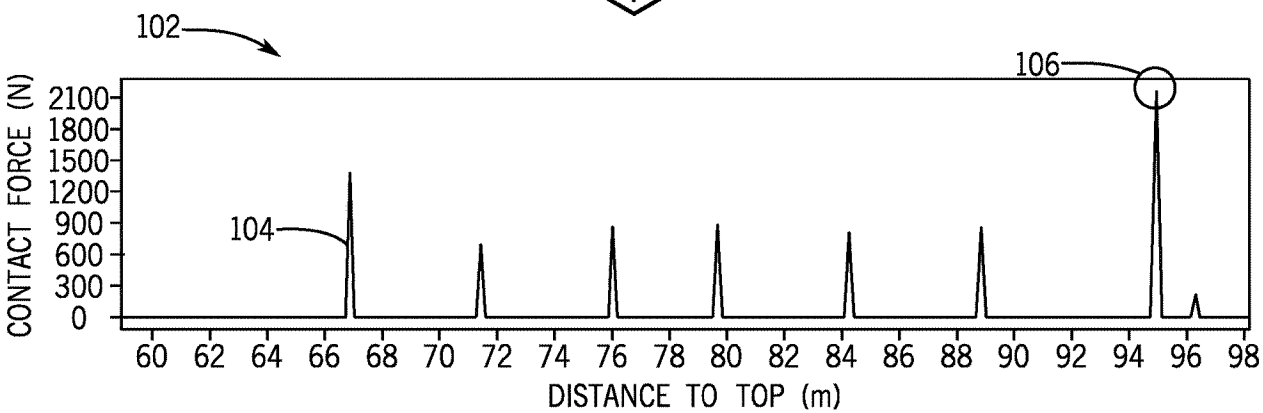
FIG. 13 is a plot of contact force along a downhole tool string with standoffs attached, in accordance with an embodiment.
Figure 14:
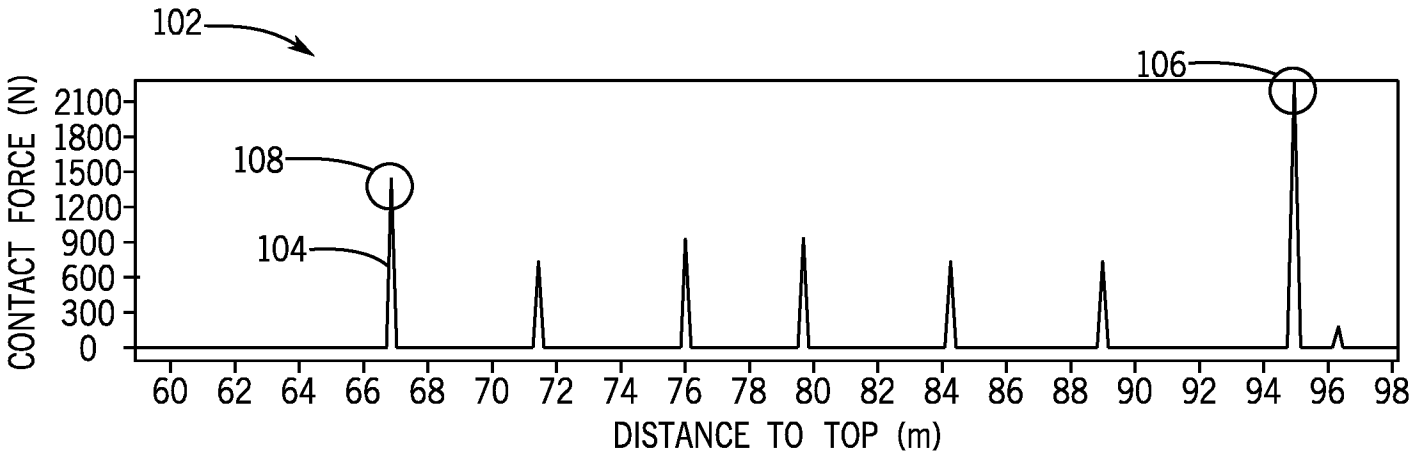
FIG. 14 is a plot of contact force along the downhole tool string with one standoff replace with a roller, in accordance with an embodiment.

Accordingly, in some embodiments, the design device 57 may use the model 69 to determine contact force at each standoff 58 (process block 94). To help illustrate, a plot 102 of a contact force curve 104 relative to length of the downhole tool string 34 is described in FIG. 13. In some embodiments, the model 69 may output the information represented by the contact force curve 104 for analysis by the design device 57. Based on the contact force curve 104, the design device 57 may determine that eight contact points are expected between the downhole tool string 34 and the mud cake 54, each of which is at a standoff 58 due to the eight sharp peaks, and the contact force at each.

Returning to the process 92 described in FIG. 12, the design device 57 may then determine whether any roller 60 are available for attachment to the downhole tool string 34 (decision block 96). In some embodiments, the design device 57 may assume an infinite number of rollers 60. However, in such embodiments, the process 92 may simply result in replacing each standoff 58 with a roller 60. Moreover, due to higher manufacturing cost, number of rollers 60 may be more limited than standoffs 58. Thus, in other embodiments, a finite number of rollers 60 may set by the design device 57, for example, based on input via the user inputs 65.

When roller 60 are available, the design device 57 may replace the standoff 58 associated with the highest expected contact force with a roller 60 (process block 99). For example, with regard to FIG. 13, the design device 57 may determine that a standoff 58 at a contact point corresponding with a third circled point 106 should be replaced with a roller 60 since the contact force curve 104 indicates that the contact point has the largest contact force at a standoff 58.

Returning to the process 92 described in FIG. 12, the design device 57 may determine whether any standoffs 58 remain attached to the downhole tool string 34 (decision block 100). When standoffs 58 remain, the design device 57 may again determine contact force at each of the remaining standoffs 58 (process block 94) and so on. In other words, the design device 57 may iteratively perform the process 92 since properties of the downhole tool string 64 may change each time a standoff 58 is replaced with a roller 60.

To help illustrate, the plot 102 of the contact force curve 104 after the standoff 58 is replace with the roller 60 is described in FIG. 10. Based on the contact force curve 104, the design device 57 may determine that contact force at the remaining standoffs 68 reduce proportionally with distance from the roller 60. In other words, contact force at standoffs 68 closer the roller 60 may reduce more than contact force at standoffs 68 farther from the roller 60. Assuming that available rollers 60 remain, the design device 57 may determine that a standoff 58 at a contact point corresponding with a fourth circled point 108 may be replaced with a roller 60 since the contact force curve 104 indicates that the contact point has the largest contact force at a standoff 58.

Returning to the process 92 described in FIG. 12, the design device 57 may continue iteratively performing the process 92 until no more standoffs 58 remain attached and/or no more roller 50 are available. Once either occurs, the design device 57 may indicate placement of roller 60 along the downhole tool string 34 (process block 98). In some embodiments, the design device 57 may indicate placement of the roller 60 using the display 63 and/or communicate the placement of the roller 60 to another electronic device via the I/O ports 67. Based at least in part on the indication, the manufacturing system may instruct the machines and/or equipment to attach standoffs 58 and/or rollers 60 to the downhole tool string 34. In some embodiments, the design device 57 may iteratively perform the process 92 to determine optimal placement (e.g., most effect to reduce effect the mud cake 54 has on movement of the downhole tool string 34) of a fixed number rollers 60 along the downhole tool string 34.

As described above, properties of the formation 12, properties of the borehole 12, and/or properties of the mud cake 54 may contain uncertainty. Additionally, as described above, properties of the formation 12, properties of the borehole 12, and/or properties of the mud cake 54 may change, for example, as the downhole tool string 34 moves along the borehole 12. To facilitate taking the uncertainty and/or changes in the properties into account, the design device 57 may determine placement of the standoffs 58 and/or roller 60 based on multiple different sets of properties.

Figure 15:
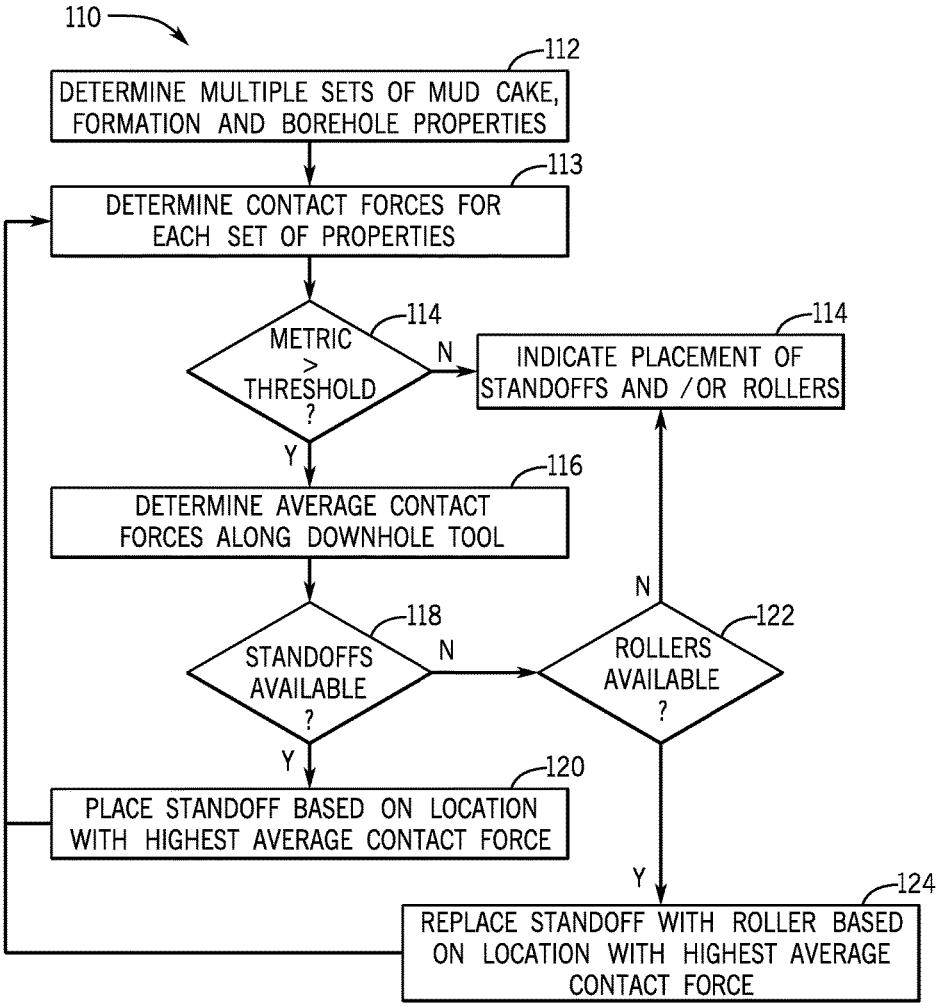
FIG. 15 is a flow diagram of a process for determining placement of standoffs and rollers along a downhole tool string, in accordance with an embodiment.

One embodiment of a process 110 for determining placement of standoffs 58 and/or rollers 60 based on multiple sets of properties is described in FIG. 15. Generally, the process 110 includes determining multiple sets of mud cake, formation, and borehole properties (process block 112), determining contact forces for each set of properties (process block 113), determining whether a contact metric is greater than a threshold (decision block 114), and indicating placement of the rollers and/or standoffs when the contact metric is not greater than the threshold (process block 115). When the contact metric is greater than the threshold, the process 110 includes determining average contact forces along the downhole tool string (process block 116), determining whether standoffs are available (decision block 118), and placing a standoff based on contact point associated with highest average contact force when standoffs are available (process block 120). When standoffs are not available, the process 110 includes determining whether rollers are available (decision block 122), replacing a standoff with a roller based on standoff with the highest average contact force when rollers are available (process block 124), and indicating placement of the rollers and/or standoffs when no more rollers are available (process block 115). In some embodiments, the process 110 may be implemented by executing instructions stored in a tangible, non-transitory, computer-readable medium, such as the memory 61 or the like, using processing circuitry, such as the processor 59 or the like.

Accordingly, in some embodiments, the design device 57 may determine multiple sets of mud cake 54, formation 12, and/or borehole 26 properties (process block 112). In some embodiments, the design device 57 may select the sets such that one or more of the properties varies within an uncertainty range between the sets. For example, the design device 57 may select a first set with a mud cake property at a first value within an uncertainty range, a second set with the mud cake property at a second value within the uncertainty range, and so on. In this manner, the design device 57 may determine placement of the standoffs 58 and/or rollers 60 while taking into account uncertainty of properties input to the model 69 and/or uncertainties of the model 69 itself.

In other embodiments, the design device 57 may select the sets such that each set represents properties at different locations in the borehole 26. For example, the design device 57 may select a first set of properties determined for a first location, a second set of properties determined for a second location, and so on. By taking into account properties of the mud cake 54, formation 12, and/or borehole 26 at different locations, the design device 57 may determine placement of the standoffs 58 and/or rollers 60 to reduce effect of the mud cake 54 while moving through the borehole 26.

As such, the technical effects of the present disclosure include improving manufacture (e.g., assembly) of a downhole tool string, for example, by improving determination of spacer placement along the downhole tool string. In some embodiments, a design device may use a model, which describes relationship between properties of the downhole tool string, a borehole, a surrounding formation, and a mud, to determine contact parameters that provide an indication of contact between the downhole tool string and the mud cake. For example, based on the contact parameters may indicate location of contact points, number of contact points, contact force at each contact point, and/or what portion (e.g., spacer or housing) of the downhole tool string contacts the mud cake. Thus, based at least in part on the contact parameters, the design device may determine location and/or type of spacers to attach to the downhole tool string. For example, the design device may iteratively place a standoff at a contact point between the housing and the mud bake associated with the highest contact force. Additionally, the design device may iteratively replace a standoff at a contact point associated with the highest contact force with a roller.

The specific embodiments described above have been shown by way of example, and it should be understood that these embodiments may be susceptible to various modifications and alternative forms. It should be further understood that the claims are not intended to be limited to the particular forms disclosed, but rather to cover modifications, equivalents, and alternatives falling within the spirit and scope of this disclosure.

What is claimed is:

1. A manufacturing system used to manufacture a downhole tool string configured to be deployed in a borehole formed in a sub-surface formation, comprising:
- a model configured to describe relationship between properties of the downhole tool string, properties of the borehole, properties of the sub-surface formation, and properties of mud cake formed on a surface of the borehole; and
- a design device configured to:
  - iteratively determine contact parameters that describe one or more contact points expected between the downhole tool string and the mud cake based at least in part on the model, wherein the contact parameters comprise contact force expected at each of the contact points;
  - adjust the properties of the downhole tool string to add a spacer at one of the contact points associated with highest contact force;
  - indicate location, type, or both, of the spacer; and
  - instruct the manufacturing system to attach the spacer to the downhole tool string based at least in part on the indicated location, type, or both, of the spacer.

2. The manufacturing system of claim 1, wherein the design device is configured to adjust the properties of the downhole tool string by replacing a standoff attached to the downhole tool string with a roller.

3. The manufacturing system of claim 1, wherein:
- the contact parameters comprise total contact force expected along the downhole tool string, number of the contact points, where the mud cake is expected to contact the downhole tool, or any combination thereof; and
- the design device is configured to:
  - determine a contact metric based at least in part on the contact parameters;
  - iteratively determine the contact parameters when the contact metric is greater than a threshold;
  - cease iteratively determining the contact parameters when the contact metric is no longer greater than the threshold; and
  - indicate the location, the type, or both, of the spacer after ceasing determination of the contact parameters.

4. The manufacturing system of claim 1, wherein:
- the properties of the downhole tool string comprise length of the downhole tool string, weight of the downhole tool string, size of a housing of the downhole tool string, material composition of the housing, type of downhole tools included in the downhole tool string, location of each spacer attached to the downhole tool string, size of each spacer attached to the downhole tool string, type of each spacer attached to the downhole tool string, or any combination thereof;
- the properties of the mud cake comprise material composition of the mud cake, thickness of the mud cake, or both;
- the properties of the sub-surface formation comprise material composition of the sub-surface formation, porosity of the sub-surface formation, or both; and
- the properties of the borehole comprise angle of the borehole, size of borehole, or both.

5. The manufacturing system of claim 1, wherein the model comprises a finite element analysis model configured to:
- receive the properties of the downhole tool string, the properties of the borehole, the properties of the sub-surface formation, and the properties of the mud cake as inputs; and
- output a curve describing the contact force expected along the downhole tool string;
- wherein the design device is configured to determine whether each contact point is associated with a housing of the downhole tool string or spacers attached around the housing based at least in part on profile of the curve.

6. The manufacturing system of claim 1, wherein the spacer comprises one of standoffs, rollers, stabilizers, or any combination thereof configured to be attached to a housing of the downhole tool string.

7. The manufacturing system of claim 1, wherein the downhole tool string comprises:
- a plurality of downhole tools configured to determine characteristics of the sub-surface formation; and
- a field joint between each pair of adjacent downhole tools along the downhole tool string.

8. The manufacturing system of claim 1, wherein:
- the design device comprises a handheld computing device, a tablet computing device, a notebook computer, a desktop computer, a workstation computer, a cloud-based computing device, or any combination thereof; and the manufacturing system comprises a manufacturing plant, a machine, equipment, or any combination thereof configured to assemble the downhole tool string.

9. A method for manufacturing a downhole tool string configured to be deployed in a borehole formed in a sub-surface formation, comprising:

determining, using a design device of a manufacturing system configured to assemble the downhole tool string, a first set of properties comprising downhole tool properties, borehole properties, formation properties, and mud cake properties;

determining, using the design device, first contact forces expected to occur between the downhole tool string and mud cake formed along a surface of the borehole based at least in part on the first set of the properties;

determining, using the design device, a second set of the properties;

determining, using the design device, second contact forces expected to occur between the downhole tool string and the mud cake;

indicating, using the design device, location, type, or both, of one or more spacers to attach to the downhole tool string based at least in part on the first contact forces and the second contact forces; and instructing, using the design device, the manufacturing system to attach the one or more spacers to the downhole tool string based at least in part on the indicated location, type, or both, of the one or more spacers.

10. The method of claim 9, wherein:

the first set of the properties correspond with the borehole properties, the formation properties, and the mud cake properties expected at a first location in the borehole; and the second set of the properties correspond with the borehole properties, the formation properties, and the mud cake properties expected at a second location in the borehole.

11. The method of claim 9, wherein:

the first set of the properties comprises at least one property of the borehole properties, the formation properties, and the mud cake properties at a first value within an uncertainty range of the property; and the second set of the properties comprises the one property at a second value within the uncertainty range.

12. The method of claim 9, comprising:

adjusting, using the design device, the downhole tool properties to add a first spacer to the downhole tool string based at least in part on the first contact forces;

determining, using the design device, the second set of the properties after adjusting the downhole tool properties; and adjusting, using the design device, the downhole tool properties to add a second spacer to the downhole tool string based at least in part on the second contact forces;

wherein the one or more spacers comprise the first spacer and the second spacer.

13. The method of claim 12, wherein:

adjusting the downhole tool properties to add the first spacer comprises adding a first standoff at a first expected contact point between a housing of the downhole tool string and the mud cake associated with highest contact force; and adjusting the downhole tool properties to add the second spacer comprises adding a second standoff at a second expected contact point between the housing and the mud cake associated with highest contact force after the first standoff is added.

14. The method of claim 12, wherein:

adjusting the downhole tool properties to add the first spacer comprises replacing a first standoff with a first roller, wherein the first standoff corresponds to a first expected contact point associated with highest expected contact force; and adjusting the downhole tool properties to add the second spacer comprises replacing a second standoff with a second roller, wherein the second standoff corresponds to a second expected contact point associated with highest contact force after the first roller is added.

15. The method of claim 9, wherein the one or more spacers comprise one or more standoffs, one or more rollers, one or more stabilizers, or any combination thereof.

16. A tangible, non-transitory, computer-readable medium configured to store instructions executable by a processor in a manufacturing system used to manufacture a downhole tool string configured to be deployed in a borehole formed in a sub-surface formation, wherein the instructions comprise instructions to:

determine, using the processor, first downhole tool string properties that indicate an initial placement of a plurality of standoffs along the downhole tool string;

determine, using the processor, a first contact force expected to occur at each of the plurality of standoffs with mud cake expected to form along a surface of the borehole based at least in part on the first downhole tool string properties, borehole properties, mud cake properties, and formation properties;

determine, using the processor, second downhole tool string properties that replace a first standoff of the plurality of standoffs with a first roller, wherein the first contact force associated the first standoff is greater than the first contact force associated with rest of the plurality of standoffs;

instruct, using the processor, a design device in the manufacturing system to indicate location, type, or both, of the first roller based at least in part on the second downhole tool string properties; and instruct, using the processor, the manufacturing system to attach the first roller to the downhole tool string based at least in part on the indicated location, type, or both, of the first roller.

17. The computer-readable medium of claim 16, wherein the first roller comprises a mechanical component configured to rotate about an axis when the mechanical component is in contact with the mud cake and the downhole tool string is in motion, wherein the first roller is configured to:

reduce expected contact force at another spacer attached to the downhole tool string; and reduce force exerted on the downhole tool string to move the downhole tool string along the borehole.

18. The computer-readable medium of claim 16, comprising instructions to:

determine, using the processor, a second contact force expected to occur at each of the plurality of standoffs based at least in part on the second downhole tool string properties, the borehole properties, the mud cake properties, and the formation properties;

determine, using the processor, third downhole tool string properties that replace a second standoff of the plurality of standoffs with a second roller, wherein the second contact force associated the second standoff is greater than the second contact force associated with the rest of the plurality of standoffs; and instruct, using the processor, the design device to indicate location, type, or both of the second roller based at least in part on the third downhole tool string properties to facilitate the manufacturing system attaching the second roller to the downhole tool string before deployment in the borehole.

19. The computer-readable medium of claim 16, wherein the instructions to determine the first contact force expected to occur at each of the plurality of standoffs comprise instructions to:

input the first downhole tool string properties, the borehole properties, the mud cake properties, and the formation properties to a finite element model configured to describe relationship between the downhole tool string, the borehole, the mud cake, and the sub-surface formation; and receive a curve that indicates expect contact force along the downhole tool string.

20. The computer-readable medium of claim 16, wherein the initial placement comprises one standoff of the plurality of standoffs attached to each field joint along the downhole tool string.

* * * * *